US010919083B2

(12) United States Patent
Xu et al.

(10) Patent No.: US 10,919,083 B2
(45) Date of Patent: Feb. 16, 2021

(54) PROCESS FOR MANUFACTURING ALUMINUM ALLOY WHEEL

(71) Applicant: CITIC Dicastal CO., LTD., Hebei (CN)

(72) Inventors: Zuo Xu, Qinhuangdao (CN); Haiping Chang, Qinhuangdao (CN); Lijuan Zhang, Qinhuangdao (CN); Shiwen Xu, Qinhuangdao (CN); Changhai Li, Qinhuangdao (CN); Zhihua Zhu, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 278 days.

(21) Appl. No.: 16/026,104

(22) Filed: Jul. 3, 2018

(65) Prior Publication Data

US 2019/0283108 A1 Sep. 19, 2019

(30) Foreign Application Priority Data

Mar. 19, 2018 (CN) ..... 201810222372.7

(51) Int. Cl.

| | |
|---|---|
| ***B21H 1/10*** | (2006.01) |
| ***B22D 25/02*** | (2006.01) |
| ***B22D 31/00*** | (2006.01) |
| ***C22F 1/04*** | (2006.01) |
| ***B22D 21/04*** | (2006.01) |
| ***B22D 21/00*** | (2006.01) |

(52) U.S. Cl.

CPC ..... *B21H 1/10* (2013.01); *B22D 21/04* (2013.01); *B22D 25/02* (2013.01); *B22D 31/00* (2013.01); *C22F 1/04* (2013.01); *B22D 21/007* (2013.01)

(58) Field of Classification Search

CPC . B21H 1/10; B21D 2/18; B21D 53/26; B21D 53/30; B21D 22/16; B23P 15/00; B23P 2700/50; B22D 25/02; B22D 21/007; B22D 18/04; B60B 3/06

See application file for complete search history.

(56) References Cited

U.S. PATENT DOCUMENTS

| | | | | |
|---|---|---|---|---|
| 3,822,458 | A * | 7/1974 | Schulte | B21K 1/28 29/894.324 |
| 2004/0139610 | A1 | 7/2004 | Suzuki | |

FOREIGN PATENT DOCUMENTS

| | | | | |
|---|---|---|---|---|
| CN | 101648329 | A | * | 2/2010 |
| CN | 101786220 | A | | 7/2010 |
| CN | 103056611 | A | | 4/2013 |
| CN | 103624235 | A | | 3/2014 |
| CN | 103757574 | A | * | 4/2014 |
| CN | 104128743 | A | * | 11/2014 |
| CN | 104128743 | A | | 11/2014 |
| CN | 104907530 | A | | 9/2015 |
| CN | 105149551 | A | | 12/2015 |
| CN | 105479105 | A | | 4/2016 |
| CN | 106623674 | A | | 5/2017 |
| CN | 106825232 | A | * | 6/2017 |
| CN | 107952948 | A | * | 4/2018 |
| JP | H03262701 | A | | 11/1991 |
| KR | 20150066493 | A | | 6/2015 |

* cited by examiner

*Primary Examiner* — Keith D. Hendricks
*Assistant Examiner* — Joshua S Carpenter
(74) *Attorney, Agent, or Firm* — Cooper Legal Group, LLC

(57) ABSTRACT

A process for manufacturing an aluminum alloy wheel includes: casting, de-flashing, soaking, spinning, thermal treatment, de-gating, X-ray and machining. During the casting, a casting mold is cooled with water, and a cast blank is produced from carrying out the casting. The de-flashing includes removing flashes of the cast blank at a rim of the cast blank with a de-flashing device. The soaking includes reheating on the cast blank that has been de-flashed. The spinning includes an adaptive spinning mold. The thermal treatment includes direct solution treatment and aging on the cast blank in a thermal treatment furnace after spinning.

3 Claims, No Drawings

PROCESS FOR MANUFACTURING ALUMINUM ALLOY WHEEL

CROSS-REFERENCE TO RELATED APPLICATION

The present application claims benefit of Chinese Patent Application No. 201810222372.7, filed on Mar. 19, 2018, the contents of which are hereby incorporated by reference in its entirety.

BACKGROUND

The cast-spun aluminum alloy wheel is an aluminum alloy wheel with spokes molded by adopting a low-pressure casting process and a rim molded by adopting a power spinning process. The process flow is: casting, cooling, X-ray, de-gating, milling of a platform, pre-machining, preheating, spinning, cooling, thermal treatment and machining Δt present, this process results in failure to effective utilization of blank temperature, low utilization rate of metal materials and high manufacturing cost. At the same time, casting and spinning are not concurrent, so automatic line production cannot be realized.

CN 104128743A published by the State Intellectual Property Office and entitled "Low-Pressure Spin-Casting Short Process for Aluminum Alloy Wheel Hub" improves the manufacturing process of an aluminum alloy wheel hub, and describes the improved process flow including melting, low-pressure casting, semi-finished product heating, spinning, thermal treatment, cooling and drilling of a center hole. The manufacturing flow does not involve X-ray inspection and cancels pre-machining, which result in subsequent safety hazards of the hub in the pressure casting process and the spinning process respectively. Although casting machines and molds have been improved to improve the quality of cast products, the products cannot be guaranteed to completely meet customer's standards. In addition, customers require full inspection with X rays on products. At the same time, the process does not describe the short process layout, the pressure casting time is long, and the spinning time is short, so there must be a reasonable match to achieve automatic line production.

SUMMARY

The present disclosure relates to the field of wheel manufacturing, and specifically, to a process for manufacturing a cast-spun aluminum alloy wheel.

A process for manufacturing an aluminum alloy wheel, the process flow including: casting, de-flashing, soaking, spinning, thermal treatment, de-gating, X-ray and machining.

During the casting, a casting mold is cooled with water, the holding pressure is 830-850 mbar, the holding pressure time is 120-150 s, the cooling time after pressure relief is 35-50 s, the production cycle is improved from original 6-6.5 min/piece to 4-4.2 min/piece, and the casting production efficiency is improved by more than 30%; and by using a full water-cooled mold, the quality of the wheel is improved, the elongations of the spokes and the wheel center are improved to 6%-8%, the elongations of the inner wheel flange and the rim are improved to 10%, and the weight of the wheel can be reduced by 0.7-1.1 kg. The water-cooled mold dispenses with air cooling and saves the cost of compressed air.

The de-flashing refers to removing flashes of a cast blank at the rim with a special de-flashing device to ensure that the rim does not have flashes after spinning, prevent the defects of folding and the like and ensure the quality of the wheel. The revolving speed of a de-flashing milling cutter is set at 300-350 r/min, the feed rate of the milling cutter is 600-1200 mm/min, the multiplying power is 150%, and the de-flashing time is 40-60 s; and the rim does not need to be pre-machined after de-flashing, so the utilization rate of materials is improved by 5%-8%.

The soaking means reheating on the cast blank that has been de-flashed thermally, so that the temperature of the rim is uniform everywhere and reaches the spinning temperature. An annular soaking furnace is adopted, the temperature is set in three zones, and the furnace gas temperature is set at 380-400° C. Since the thermal blank is fed into the furnace, the casting residual heat is fully utilized.

An adaptive spinning mold is adopted for the spinning, the conventional back cavity contour matching method is adjusted, and the casting blank with a window sealing layer and the accurate inner diameter of the wheel well are adopted to realize contact with the spinning mold, so as to ensure that the same type of blanks made in different molds are effectively matched with the spinning mold and overcome the spinning defects of spoke bulging, end face deformation and the like; the initial temperature of the mold is 200° C., the tail cap pressure is set at 4.5-6 Mpa, and the spinning roller feed rate is 400-600 mm/min; and the spinning time is 40-60 s. The thermal treatment refers to direct solution treatment and aging on the high-temperature blank in a thermal treatment furnace after spinning, the solution treatment temperature is set at 545° C., the holding temperature time is set at 240-280 min, the quenching temperature is set at 75° C., the aging temperature is set at 155° C., and the holding temperature time is set at 150-180 min. The cooling link is canceled, so that the residual heat is fully utilized, natural gas for the thermal treatment furnace is saved and the cost is reduced by 0.3-0.5 yuan/piece. At the same time, since the high-temperature blank is fed into the furnace, the process has the characteristics of reduction on deformation of the wheel, sufficient solution treatment, good wheel performance and the like.

The de-gating and X-ray processes are carried out behind the thermal treatment process to ensure the quality of the machining process and the finished product.

The process layout of the present disclosure is the construction layout of a production line: the coordination of casting, spinning and thermal treatment is ensured; four pressure casting machines are matched with one spinning machine, one blank de-flashing device is added, a pre-machining link is canceled, the cast blank carrying residual heat is fed into the soaking furnace to cancel a cooling link, the blank carrying residual heat is directly thermally treated after spinning, and the de-gating and the X-ray inspection are carried out behind the thermal treatment.

The present disclosure reduces the cost by about 18 yuan (about 2.8 USD)/piece and reduces the weight of the finished product by 0.7-1.1 Kg by improving the casting production efficiency and the product quality, saving original cooling compressed air, canceling pre-machining, preheating and spinning the thermal blank, thermally treating the thermal blank and the like, has the cost equivalent to the comprehensive manufacturing cost of an ordinary cast wheel, and improves the market competitiveness of the cast-spun wheel. The process realizes short flow, light weight and low cost for manufacturing a cast-spun wheel, achieves intelligence of machining, and is suitable for automatic production of large-batch cast-spun wheels.

DETAILED DESCRIPTION

In an embodiment of a process for manufacturing an aluminum alloy wheel, the process flow includes: casting, de-flashing, soaking, spinning, thermal treatment, de-gating, X-ray and machining.

A full water-cooled mold is developed for the casting, i.e., a casting mold is cooled with water, the holding pressure is 830 mbar, the holding pressure time is 120 s, the cooling time after pressure relief is 35 s, the production cycle is improved from original 6 min/piece to 4 min/piece, and the casting production efficiency is improved by 33%; and by using the full water-cooled mold, the quality of the wheel is improved, the elongations of the spokes and the wheel center are improved to 6%, the elongations of the inner wheel flange and the rim are improved to 10%, and the weight of the wheel can be reduced by 0.7 kg. The water-cooled mold dispenses with air cooling and saves the cost of compressed air.

The de-flashing refers to removing flashes of a cast blank at the rim with a special de-flashing device to ensure that the rim does not have flashes after spinning, prevent the defects of folding and the like and ensure the quality of the wheel. The revolving speed of a de-flashing milling cutter is set at 300 r/min, the feed rate of the milling cutter is 600 mm/min, the multiplying power is 150%, and the de-flashing time is 40 s; and the rim does not need to be pre-machined after de-flashing, so the utilization rate of materials is improved by 5%.

The soaking means reheating on the cast blank that has been de-flashed thermally, so that the temperature of the rim is uniform everywhere and reaches the spinning temperature. An annular soaking furnace is adopted, the temperature is set in three zones, and the furnace gas temperature is set at 380° C. Since the thermal blank is fed into the furnace, the casting residual heat is fully utilized.

The spinning process is to develop an adaptive spinning mold, adjusting the traditional back cavity contour matching method, using the casting blank with a window sealing layer and precise contact with the inner diameter of the wheel well to ensure that the blank of the same mold with its effective cooperation. Eliminating spun bulging, end face deformation and other spinning defects; mold starting temperature is 200° C., tail pressure is set at 4.5 Mpa, roller feed rate is 400 mm/min; spinning pressure is 40 seconds.

The thermal treatment refers to direct solution treatment and aging on the high-temperature blank in a thermal treatment furnace after spinning, the solution treatment temperature is set at 545° C., the holding temperature time is set at 240 min, the quenching temperature is set at 75° C., the aging temperature is set at 155° C., and the holding temperature time is set at 150 min. The cooling link is canceled, so that the residual heat is fully utilized. At the same time, since the high-temperature blank is fed into the furnace, the process has the characteristics of reduction on deformation of the wheel, sufficient solution treatment, good wheel performance and the like.

In another embodiment, a full water-cooled mold is developed for the casting, i.e., a casting mold is cooled with water, the holding pressure is 850 mbar, the holding pressure time is 150 s, the cooling time after pressure relief is 50 s, the production cycle is improved from original 6.5 min/piece to 4.2 min/piece, and the casting production efficiency is improved by 35%; and by using the full water-cooled mold, the quality of the wheel is improved, the elongations of the spokes and the wheel center are improved to 8%, the elongations of the inner wheel flange and the rim are improved to 10%, and the weight of the wheel can be reduced by 1.1 kg.

The de-flashing refers to removing flashes of a cast blank at the rim with a special de-flashing device to ensure that the rim does not have flashes after spinning, prevent the defects of folding and the like and ensure the quality of the wheel. The revolving speed of a de-flashing milling cutter is set at 350 r/min, the feed rate of the milling cutter is 1200 mm/min, the multiplying power is 150%, and the de-flashing time is 60 s; and the rim does not need to be pre-machined after de-flashing, so the utilization rate of materials is improved by 8%.

The soaking means reheating on the cast blank that has been de-flashed thermally, so that the temperature of the rim is uniform everywhere and reaches the spinning temperature. An annular soaking furnace is adopted, the temperature is set in three zones, and the furnace gas temperature is set at 400° C. Since the thermal blank is fed into the furnace, the casting residual heat is fully utilized.

An adaptive spinning mold is developed for the spinning, the conventional back cavity contour matching method is adjusted, and the casting blank with a window sealing layer and the accurate inner diameter of the wheel well are adopted to realize contact with the spinning mold, so as to ensure that the same type of blanks made in different molds are effectively matched with the spinning mold and overcome the spinning defects of spoke bulging, end face deformation and the like; the initial temperature of the mold is 200° C., the tail cap pressure is set at 6 Mpa, and the spinning roller feed rate is 600 mm/min; and the spinning time is 60 s.

The thermal treatment refers to direct solution treatment and aging on the high-temperature blank in a thermal treatment furnace after spinning, the solution treatment temperature is set at 545° C., the holding temperature time is set at 280 min, the quenching temperature is set at 75° C., the aging temperature is set at 155° C., and the holding temperature time is set at 180 min. The cooling link is canceled, so that the residual heat is fully utilized, natural gas for the thermal treatment furnace is saved and the cost is reduced by 0.5 yuan/piece. At the same time, since the high-temperature blank is fed into the furnace, the process has the characteristics of reduction on deformation of the wheel, sufficient solution treatment, good wheel performance and the like.

The process for manufacturing a lightweight aluminum alloy wheel according to the present disclosure is not limited to the content described in the specific embodiments of the present disclosure, and other design methods obtained according to the content of the present disclosure all fall into the protection scope of the present disclosure.

The invention claimed is:

1. A process for manufacturing an aluminum alloy wheel, the process comprising: casting, de-flashing, soaking, spinning, thermal treatment, de-gating, X-ray and machining;

during the casting, a casting mold is cooled with water, a holding pressure is 830-850 mbar, a holding pressure time is 120-150 s, and a cooling time after pressure relief is 35-50 s, wherein a cast blank is produced from the casting;

the de-flashing comprises removing flashes of the cast blank at a rim of the cast blank with a de-flashing device, a revolving speed of a de-flashing milling cutter of the de-flashing device being set at 300-350 r/min, a feed rate of the de-flashing milling cutter being 600-1200 mm/min, a multiplying power being 150%, and a de-flashing time being 40-60 s;

the soaking comprises reheating of the cast blank that has been de-flashed, an annular soaking furnace being used during the soaking, a temperature of the annular soaking furnace being set in three zones, and a furnace gas temperature of the annular soaking furnace being set at 380-400° C.;

the spinning comprises an adaptive spinning mold, the cast blank with a window sealing layer and an inner diameter of a wheel well of the cast blank being used to realize contact with the adaptive spinning mold, an initial temperature of the adaptive spinning mold being 200° C., a tail cap pressure being set at 4.5-6 Mpa, a spinning roller feed rate being 400-600 mm/min, and a spinning time being 40-60 s;

the thermal treatment comprises direct solution treatment and aging on the cast blank in a thermal treatment furnace after the spinning, a solution treatment temperature being set at 545° C., a solution treatment holding temperature time being set at 240-280 min, a quenching temperature being set at 75° C., an aging temperature being set at 155° C., and an aging holding temperature time being set at 150-180 min.

2. The process for manufacturing an aluminum alloy wheel according to claim 1, wherein for the casting, the holding pressure is 830 mbar, the holding pressure time is 120 s, and the cooling time after pressure relief is 35 s;

for the de-flashing, the revolving speed of the de-flashing milling cutter is set at 300 r/min, the feed rate of the de-flashing milling cutter is 600 mm/min, the multiplying power is 150%, and the de-flashing time is 40 s;

for the soaking, the furnace gas temperature is set at 380° C.;

for the spinning, the initial temperature of the adaptive spinning mold is 200° C., the tail cap pressure is set at 4.5 Mpa, the spinning roller feed rate is 400 mm/min, and the spinning time is 40 s;

for the thermal treatment, the solution treatment temperature is set at 545° C., the solution treatment holding temperature time is set at 240 min, the quenching temperature is set at 75° C., the aging temperature is set at 155° C., and the aging holding temperature time is set at 150 min.

3. The process for manufacturing an aluminum alloy wheel according to claim 1, wherein for the casting, the holding pressure is 850 mbar, the holding pressure time is 150 s, and the cooling time after pressure relief is 50 s;

for the de-flashing, the revolving speed of the de-flashing milling cutter is set at 350 r/min, the feed rate of the de-flashing milling cutter is 1200 mm/min, the multiplying power is 150%, and the de-flashing time is 60 s;

for the soaking, the furnace gas temperature is set at 400° C.;

for the spinning, the initial temperature of the adaptive spinning mold is 200° C., the tail cap pressure is set at 6 Mpa, the spinning roller feed rate is 600 mm/min, and the spinning time is 60 s;

for the thermal treatment, the solution treatment temperature is set at 545° C., the solution treatment holding temperature time is set at 280 min, the quenching temperature is set at 75° C., the aging temperature is set at 155° C., and the aging holding temperature time is set at 180 min.

* * * * *